US006259871B1

(12) United States Patent
Rider et al.

(10) Patent No.: US 6,259,871 B1
(45) Date of Patent: Jul. 10, 2001

(54) PAPER COOLING SYSTEM

(75) Inventors: Jason P. Rider, Penfield; Donato D. Evangelista, Webster; Leroy R. Requa, Ontario; Russell C. Rackett, Webster; Elden R. Morrison, Rochester, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/184,255

(22) Filed: Nov. 2, 1998

(51) Int. Cl.[7] ..... G03G 21/20
(52) U.S. Cl. ..... 399/92; 399/405

(58) Field of Search ..... 399/92, 94, 405, 399/91, 68, 407

(56) References Cited

U.S. PATENT DOCUMENTS 3,901,591 8/1975 Mitsumasu .
5,557,388 * 9/1996 Creutzmann .
5,563,681 * 10/1996 Kirkwold et al. .

* cited by examiner

*Primary Examiner*—Sandra Brase
(74) *Attorney, Agent, or Firm*—Andrew D. Ryan

(57) ABSTRACT

A method and apparatus for cooling copy sheets in a high speed copy machine while en route to an output tray. The invention utilizes a blower connected to manifolds positioned on opposite sides of copy sheets transported in a paper path en route to the output tray. Airflow is supplied to both sides of copy sheets as they are conveyed throughout the paper path in order to cool the copy sheets before they enter the output tray and thereby prevent fusing of the copy sheets together.

8 Claims, 2 Drawing Sheets

PAPER COOLING SYSTEM

This invention relates generally to exit tray stacking in printers or copiers, and more particularly concerns a paper cooling system for cooling copy sheets before they enter an exit tray where sheet stacking is performed.

BACKGROUND OF THE INVENTION

As xerographic copiers and printers of all kinds increase in speed or decrease in paper path length to achieve smaller equipment footprints, heat provided to imaged sheets by fusing methods has significantly less time to dissipate prior to stacking. This results in an excess amount of heat stored in each copy sheet as it is delivered to a stacker or finisher. When these printed sheets are stacked, the combination of excess heat and pressure of the stack weight can fuse the two face to face images together. In the duplex mode, if the stack is left undisturbed, allowing the copy sheets to cool in the stack, the toner on the simplex side of one sheet can stick to the toner on the duplex side of the next sheet, thus fusing the sheets together. Obviously, it is difficult to subsequently separate these sheets, particularly in off-line finishing devices.

The following disclosure may be relevant to various aspects of the present invention and may be briefly summarized as follows:

U.S. Pat. No. 3,901,591 issued to Sakae Mitsumasu is directed to a mechanism for cooling photosensitive materials in an electrophotographic copying machine that includes a cooling means for blowing a first air stream onto the surface of a photosensitive material and an air directing means for producing a second air stream through a thermal fixing device with the second air stream operating to draw the first air stream into and through the fixing device. A ventilator collects and discharges the air stream produced by the cooling means and the air directing means out of the copying machine after passing through the fixing device.

The above reference cited herein is incorporated by reference for its teaching.

Accordingly, although known apparatus and processes are suitable for their intended purposes, a need remains for an apparatus that can cool copy sheets before they enter a stacking or output tray.

SUMMARY OF THE INVENTION

In accordance with the present invention, there is provided an apparatus for transporting copy sheets traveling at high rates of speed through a paper path to a fuser and then to a copy sheet stacking tray, which apparatus includes a system for cooling copy sheets after they exit the fuser and before they enter the copy sheet stacking tray. The apparatus includes a blower connected to two manifolds by way of a ducting system. The manifolds supply airflow over upper and lower surfaces of each copy sheet and thereby cools both copy sheet surfaces before they reach the copy sheet stacking tray.

BRIEF DESCRIPTION OF THE DRAWINGS

Other features and advantages of the present invention will become apparent as the following description proceeds and upon reference to the drawings, in which.

DETAILED DESCRIPTION OF THE PREFERRED EMBODIMENT

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
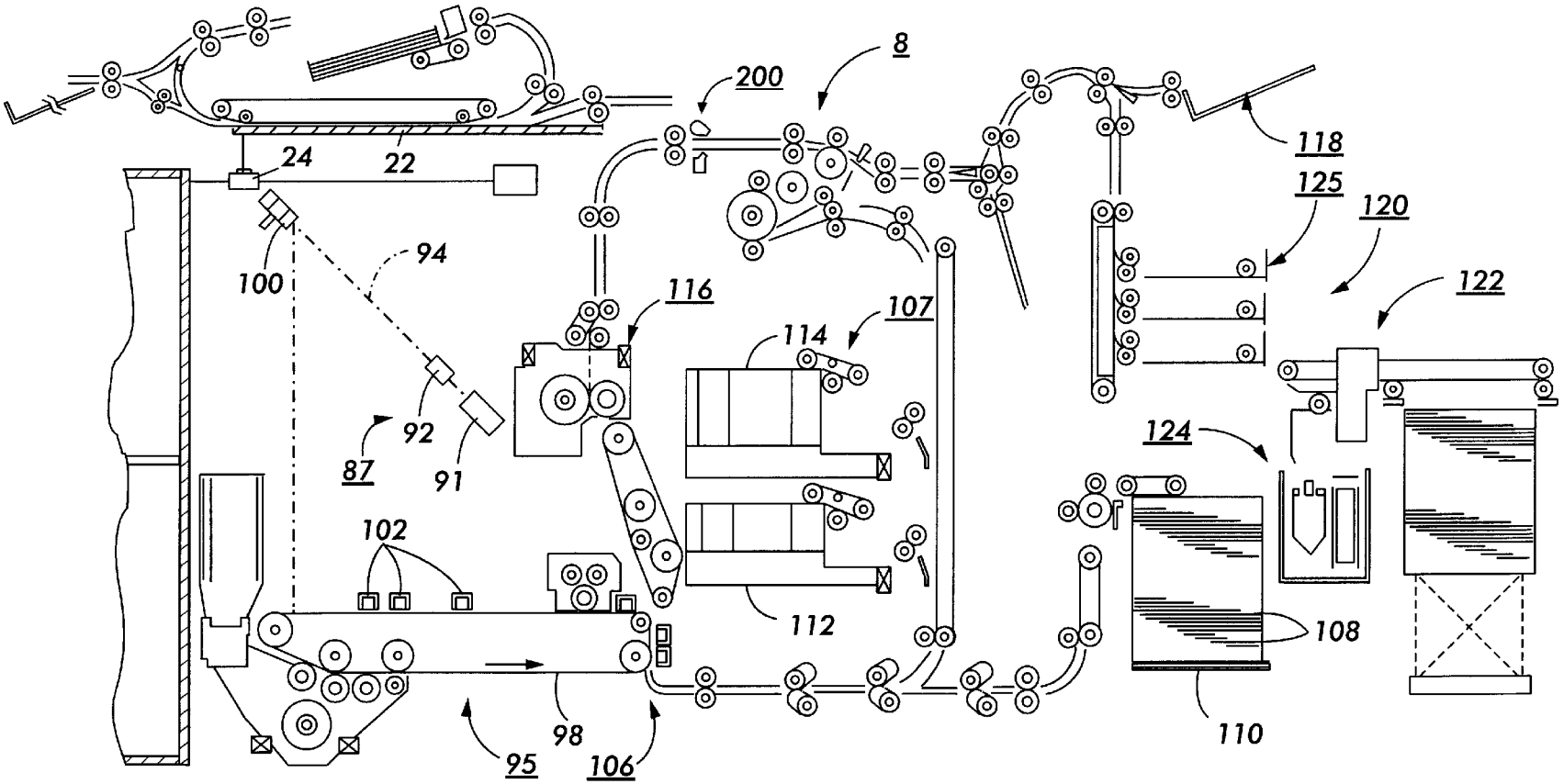
FIG. 1 is an elevation view illustrating the principal mechanical components of a typical printing system that incorporates the copy sheet cooling system of the present invention.

Referring now to the drawings, the various processing stations employed in a typical printing machine are depicted in FIG. 1. Printer section 8 comprises a laser type printer and for purposes of explanation is separated into a Raster Output Scanner (ROS) section 87, Print Module Section 95, Paper Supply section 107, and Finisher 120. ROS 87 has a laser, the beam of which is split into two imaging beams 94. Each beam 94 is modulated in accordance with the content of an image signal input and in this example, by acousto-optic modulator 92, to provide dual imaging beams 94. Other arrangements for modulating beams 94 are possible, and the invention is not limited to this embodiment. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. After exposure with beams 94, the latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, or to output collating trays in finisher 120. Finisher 120 includes a stitcher 122 for stitching (stapling) the prints together to form books, a thermal binder 124 for adhesively binding the prints into books and a stacker 125.

Figure 2:
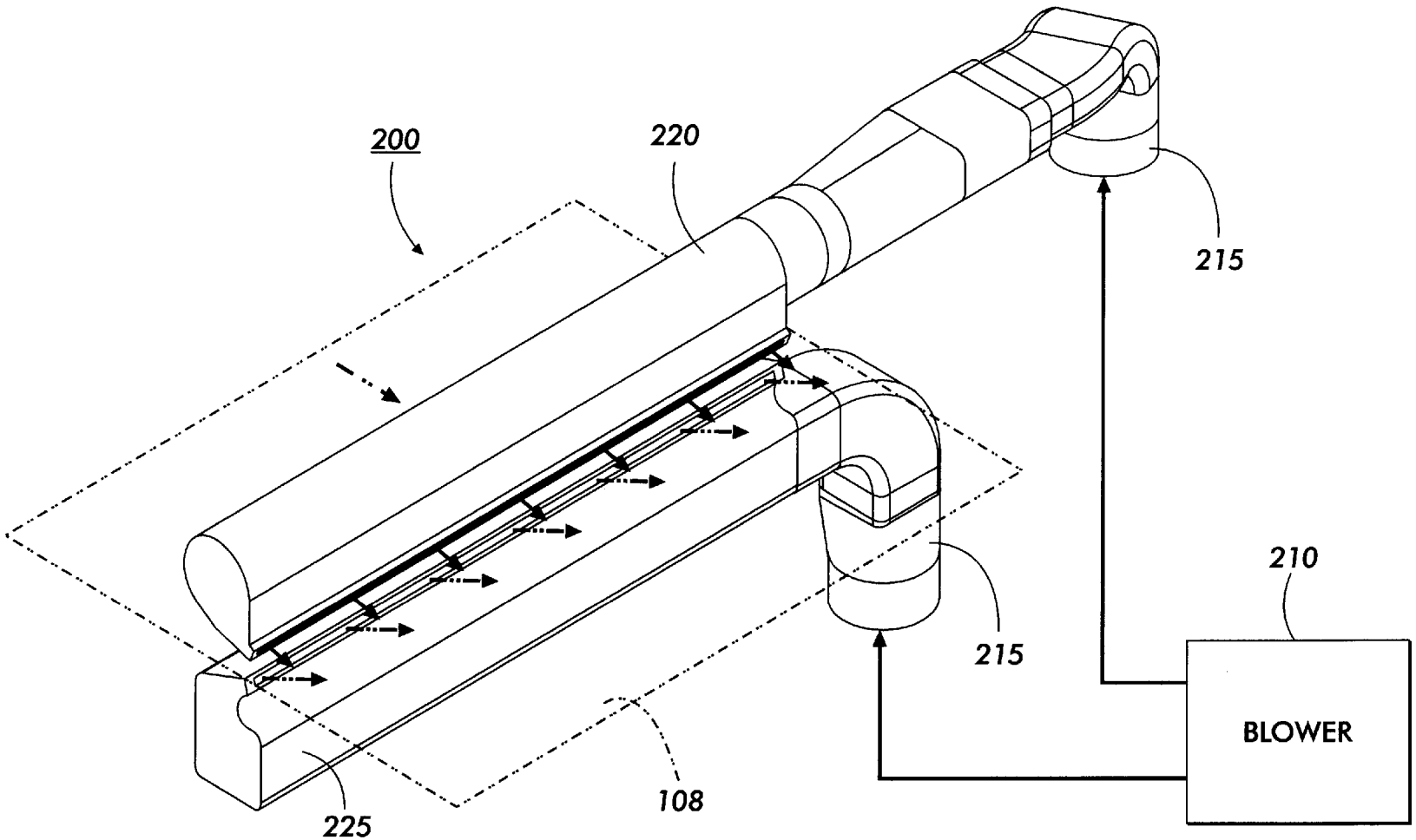
FIG. 2 is a schematic isometric view of the copy sheet cooling apparatus in accordance with the present invention and employed in the printing system of FIG. 1.

Reference is now made to FIG. 2, which shows an isometric view of the copy sheet cooling system 200 of the present invention. The system is configured to supply a large amount of air in a small area and focused directly onto each copy sheet in order to cool each copy sheet without requiring an air conditioning unit or a cooling system that cools the entire machine. The cooling system 200 comprises a blower 210 connected by ducting 215 to a pair of manifolds 220 and 225. The blower is required to supply the necessary air flow onto copy sheets and is located near the bottom of copier/printer of FIG. 1 in order to draw cooler air than is at the top of the copier/printer. If necessary, the blower can also be used to draw external ambient air to cool the copy sheets even further. Conventional ducting 215 routes the airflow from blower 210 to upper manifold 220 and lower manifold 225. The ducting cross-sectional area is the same as that of the blower outlet in order to eliminate back pressure and to maximize the air flow that reaches the manifolds. Manifolds 220 and 225 have their exits positioned to apply cool air to copy sheets into a small gap where two separate transports meet. Each manifold is configured to be long enough so that air is blown over a majority of the length of each copy sheet and the entire width of each copy sheet is cooled as each sheet is moved past the manifolds by the copy sheet transport system of the copier/printer. The air is blown at acute angles towards the copy sheets so that in addition to the initial contact from the airflow on the copy sheets, cooler air will follow the copy sheets and provide even further cooling. Both manifolds 220 and 225 are preferred with one on each side of a copy sheet transport path in order to supply air to both sides of a copy sheet conveyed through the transport path and thereby contact as much surface area of each copy sheet as possible, and thus magnify the cooling effect and to assist in preventing jams in the paper paths of the copier/printer. Using only one manifold is contemplated, but complicated since the edge of a copy sheet can be blown out of the paper path causing a jam. If the gap between transports is small enough, using a single manifold on one side of the sheet is feasible. However, it should be tested to assure that the edge of the sheet is not blown out of the transport, and should be used only when there are space limitations whereas both manifolds cannot fit. If one manifold is utilized, it should be positioned on the side of the copy sheet that was just printed, as that side of the sheet contains the most heat. By blowing on each side of the copy sheets, there is assurance that the copy sheets maintain a straight path into the next transport. It should be understood that the outlets of cooling system 200 could be designed into the paper transports, if desired.

In recapitulation, the present invention discloses a technique used to cool copy sheets prior to stacking in an output tray. In high speed or short paper transport copier/printing machines, heat provided into each imaged sheet during the fusing process has an inadequate amount of time to dissipate. If the copy sheets are stacked without cooling, they will stick together as the toner cures. A blower and associated ductwork are mounted in a copier/printer such that ambient air is blown, uniformly, across at least one copy sheet surface, sufficiently cooling it before it is stacked. Preferably, air is blown over both sides, thereby giving greater cooling effects.

It is, therefore, apparent that there has been provided in accordance with the present invention, a copy sheet cooling system for high speed document reproduction that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for cooling sheets in a copier/printer after they exit a fuser comprising:

two manifolds with outlets directed to apply airflow in a downstream running direction of the paper path wherein the outlets of said manifolds are positioned at acute angles with respect to the downstream running direction of the paper path so as to apply airflow to the sheets as they pass the outlets of the manifolds and wherein the outlets apply airflow to follow the sheets as they pass downstream of the outlets of the manifolds; and a blower adapted to apply positive airflow to said manifolds in order to cool sheets passing said outlets of said manifolds, wherein said manifolds are positioned above and below the paper path so as to apply airflow across upper and lower surfaces of sheets that include length and width.

2. The apparatus as recited in claim 1, wherein said manifolds have airflow outlets that span substantially the length of sheets passing thereover.

3. The apparatus of claim 1 further comprising ducting functionally associated with the manifolds wherein a cross-sectional area of the ducting is the same as a cross-sectional area of a outlet of the blower.

4. The apparatus of claim 1 wherein the outlets are formed in a paper transport for cooling the sheets.

5. A method for cooling sheets within a paper path of a copier/printer after images on the sheets have been fused and before the sheets enter a stacking tray, comprising:

moving each sheet along the paper path;

providing a blower;

placing manifolds above and below the paper path with outlets directed to apply airflow in a downstream running direction of the paperpath;

positioning said outlets of said manifolds at an acute angle with respect to the paper path so as to apply airflow across upper and lower surfaces of the sheets conveyed through the paper path;

connecting said manifolds to said blower; and applying airflow through said manifolds from said blower over each sheet passing through the paper path and downstream of the outlets of the manifolds and applying airflow to follow sheets as they pass downstream of the outlets of the manifolds.

6. A copier/printer adapted to place images on sheets and fuse the images to the sheets includes a system for cooling the sheets after they exit a fuser of the copier/printer in order to prevent the sheets from adhering to each other while resting in a compiler, comprising:

two manifolds with outlets directed to apply airflow toward the sheets at an acute angle with respect to the downstream running direction of a paper path and to apply airflow to follow the sheets as they pass downstream of the outlets as they are conveyed toward the compiler; and a blower adapted to apply positive airflow to said manifolds in order to cool sheets passing said outlets, wherein said outlets direct airflow across upper and lower surfaces of the sheets.

7. The apparatus as recited in claim 6, wherein said manifolds have airflow outlets that span substantially the length of sheets passing thereover.

8. The apparatus as recited in claim 6, wherein said at least one manifold includes manifolds that are positioned on opposite sides of the paper path so as to apply airflow to upper and lower surfaces of sheets that include length and width.

* * * * *